United States Patent [19]

Yokoya

[11] Patent Number: 4,472,831

[45] Date of Patent: Sep. 18, 1984

[54] AM STEREOPHONIC TRANSMITTER

[75] Inventor: Satoshi Yokoya, Chofu, Japan

[73] Assignee: Sony Corporation, Tokyo, Japan

[21] Appl. No.: 390,901

[22] Filed: Jun. 22, 1982

[30] Foreign Application Priority Data

Jul. 7, 1981 [JP] Japan ..... 56-106126

[51] Int. Cl.[3] ..... H04H 5/00

[52] U.S. Cl. ..... 381/16; 332/37 D; 381/15

[58] Field of Search ..... 332/21, 22, 37 R, 37 D, 332/40, 41, 45, 48; 381/15, 16

[56] References Cited

U.S. PATENT DOCUMENTS 4,185,171 1/1980 Parker ..... 381/16

4,373,115 2/1983 Kahn ..... 381/15

*Primary Examiner*—A. D. Pellinen

*Attorney, Agent, or Firm*—Lewis H. Eslinger; Alvin Sinderbrand

[57] ABSTRACT

An AM stereophonic signal transmitter includes a matrix circuit which generates a sum signal corresponding to the sum of left and right channel stereophonic signals and a difference signal corresponding to the difference between the left and right channel stereophonic signals; a first phase shifting circuit which phase shifts the sum signal by −45°; a second phase shifting circuit which phase shifts the difference signal by +45°; a sub-modulator which modulates the phase-shifted difference signal by the phase-shifted sum signal to produce a first modulated output signal having the form $Y_+(1+m_tX_-)$, where $X_-$ represents the phase-shifted sum signal, $m_t$ represents the modulation factor of the sub-modulator and 1 represents a carrier component; a modifying circuit for modifying the phase-shifted sum signal to produce a modified signal having the form $\sqrt{(1+X_-)^2-Y_+^2(1+m_tX_-)^2}$, where $Y_+$ represents the phase-shifted difference signal, and which provides that the AM stereophonic signal transmitted by the transmitter has a substantially distortion-free envelope component; a first multiplier for modulating a $-\sin\omega_c t$ carrier signal by the first modulated output signal; a second multiplier for modulating a $\cos\omega_c t$ carrier signal by the modified signal; and an adder for adding the outputs of the first and second multipliers to produce the AM stereophonic signal having a substantially distortion-free envelope component which is to be transmitted.

8 Claims, 7 Drawing Figures

AM STEREOPHONIC TRANSMITTER

BACKGROUND OF THE INVENTION

1. Field of the Invention

This invention relates generally to apparatus for transmitting an AM stereophonic signal and, more particularly, is directed to apparatus for transmitting an AM stereophonic signal of the independent side band type.

2. Description of the Prior Art

Systems for transmitting AM stereo signals are known in the art. In one known system, a matrix circuit produces a sum signal (L+R) corresponding to the sum of left (L) and right (R) channel stereophonic signals and a difference signal (L−R) corresponding to the difference of the left (L) and right (R) channel stereophonic signals. The sum and difference signals are thereafter phase shifted to provide a phase difference of 90° between the two signals. Thereafter, the phase shifted sum signal is multiplied with a carrier signal cos $\omega_c t$ and the phase shifted difference signal is multiplied by a carrier signal $-\sin \omega_c t$. The two multiplied signals are then combined with each other, along with the carrier signal cos $\omega_c t$, and the resultant signal is transmitted through a transmitting antenna as an independent side band (ISB) AM stereophonic signal.

With the above system, because of the phase-shifting arrangement, the side band wave $\omega_c - P$ of the left (L) channel signal is produced at a lower side band (LSB) of the carrier $\omega_c$. In like manner, the side band wave of the right (R) channel signal is generated at the upper side band (USB) of the carrier $\omega_c$. However, with such systems, if the signal is biased to either side of the left (L) channel or the right (R) channel, the resultant signal becomes a single side band (SSB) wave which generally contains a second order distortion component in the envelope thereof. Accordingly, with an AM stereophonic receiver which uses a conventional diode envelope detector, a relatively large distortion is produced, for example, a maximum distortion of the order of approximately 13%.

OBJECTS AND SUMMARY OF THE INVENTION

Accordingly, it is an object of this invention to provide an AM stereophonic transmitter that avoids the above-described difficulties encountered with the prior art.

More particularly, it is an object of this invention to provide an AM stereophonic transmitter which provides a substantially distortion-free envelope component when the transmitted signal is received by an AM stereophonic receiver.

It is another object of this invention to provide an AM stereophonic transmitter which is compatible with a monaural receiver.

In accordance with an aspect of this invention, apparatus for transmitting an AM stereophonic signal includes matrix means for generating a sum signal corresponding to the sum of left and right channel stereophonic signals and a difference signal corresponding to the difference of the left and right channel stereophonic signals; phase shifting means for phase shifting at least one of the sum and difference signals to produce phase-shifted sum and difference signals having a phase difference of substantially 90° therebetween; first modulating means for modulating the phase-shifted difference signal by the phase-shifted sum signal to produce a first modulated output signal; second modulating means for modulating a first carrier by the first modulated output signal to produce a second modulated output signal; means for modifying the phase-shifted sum signal to produce a modified signal which provides that the transmitted AM stereophonic signal has a substantially distortion-free envelope component; third modulating means for modulating a second carrier with the modified signal to produce a third modulated output signal, the second carrier having a frequency equal to the frequency of the first carrier and a phase shifted by substantially 90° from the phase of the first carrier; and adder means for adding the second modulated output signal and the third modulated output signal to form the transmitted AM stereophonic signal having a substantially distortion-free envelope component.

The above, and other, objects, features and advantages of the present invention will become apparent from the following detailed description of illustrative embodiments of the invention which is to be read in connection with the accompanying drawings.

DETAILED DESCRIPTION OF THE PREFERRED EMBODIMENTS

Figure 1:
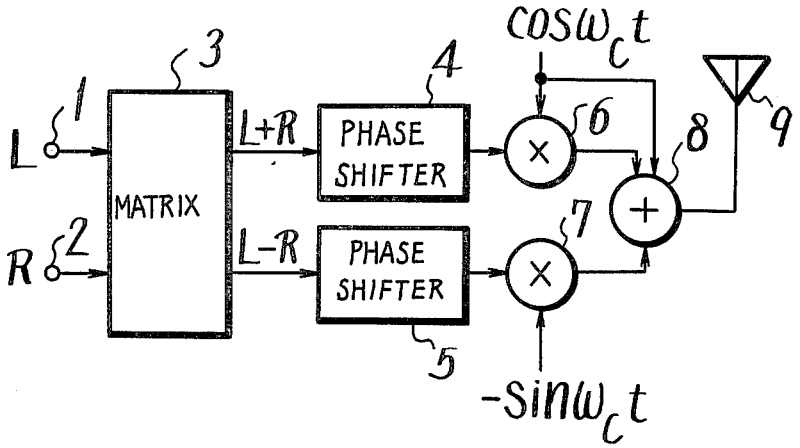
FIG. 1 (PRIOR ART)
FIG. 1 is a block diagram of a prior art AM stereophonic transmitter.

Referring to the drawings in detail, and initially to FIG. 1 thereof, an AM stereophonic transmitter of the independent side band (ISB) type includes a matrix circuit 3 supplied with a left (L) channel stereophonic signal from an input terminal 1 and a right (R) channel stereophonic signal from an input terminal 2. In response to these inputs, matrix circuit 3 produces a sum signal (L+R) corresponding to the sum of the left (L) and right (R) channel stereophonic signals, and a difference signal (L−R) corresponding to the difference between the left (L) and right (R) channel stereophonic signals. The sum signal (L+R) is supplied to a phase shifting circuit 4 which phase shifts the sum signal by −45°, and the difference signal (L−R) is supplied to a phase shifting circuit 5 which phase shifts the difference signal by +45°. In this manner, the sum and difference signals are phase shifted so as to have a phase difference of substantially 90° therebetween.

The phase-shifted sum signal is thereafter multiplied with a carrier signal cos $\omega_c t$ by a multiplier 6, and the phase-shifted difference signal is multiplied with a carrier signal $-\sin \omega_c t$ by a multiplier 7. The multiplied signals from multipliers 6 and 7 are than supplied to respective adding inputs of an adder 8, and the carrier signal $\cos \omega_c t$ is supplied to another input of adder 8, the latter circuit combining the three signals to produce an ISB AM stereophonic signal which is supplied to an antenna 9 for transmission.

Figure 2:
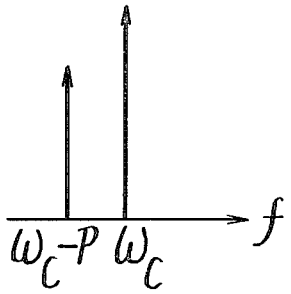
FIG. 2 is a graphical diagram used to explain the operation of the AM stereophonic transmitter of FIG. 1.

With the transmitter of FIG. 1, due to the phase shifting circuits 4 and 5, the side band wave $\omega_c - P$ of the left (L) channel stereophonic signal is produced at a lower side band (LSB) of the carrier $\omega_c$, as shown in FIG. 2. In like manner, the side band wave (not shown) of the right (R) channel stereophonic signal is generated at the upper side band (USB) of the carrier $\omega_c$. However, if the signal is biased to either side of the left (L) channel or the right (R) channel, the signal becomes a single side band (SSB) wave which generally contains a second order distortion component in the envelope thereof. Accordingly, with an AM stereophonic receiver using a conventional diode envelope detector, a relatively large distortion is generated, for example, a maximum distortion of approximately 13%.

Figure 3:
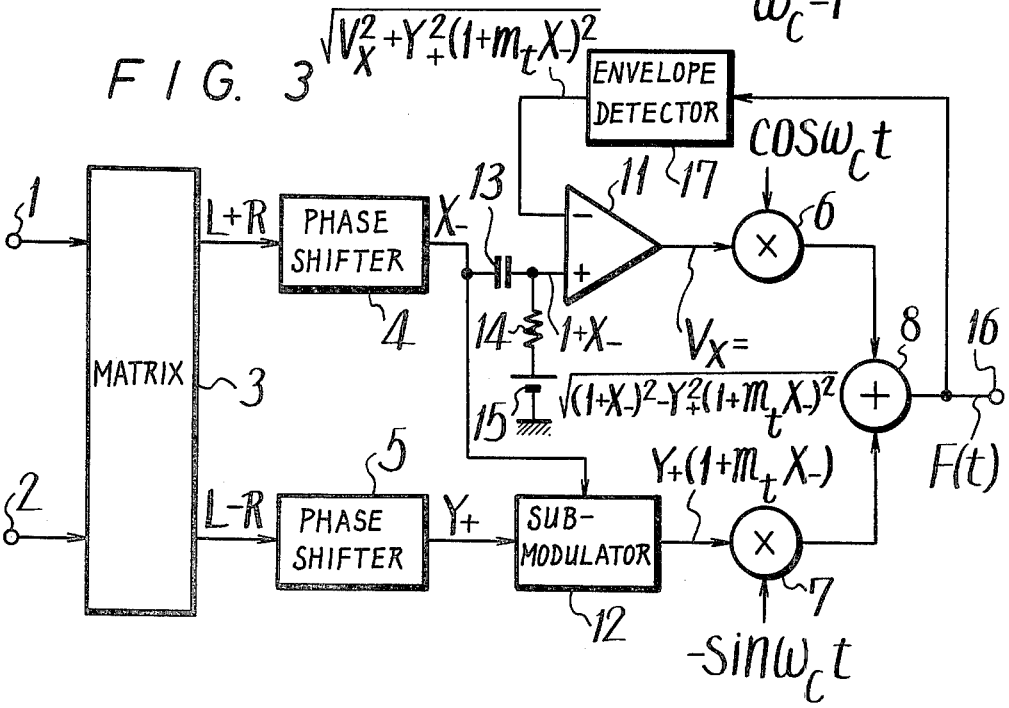
FIG. 3 is a block, circuit-wiring diagram of an AM stereophonic transmitter according to one embodiment of this invention.

Referring now to FIG. 3, an encoding portion of an AM stereophonic transmitter according to one embodiment of the invention which provides an AM stereophonic signal having a substantially distortion-free envelope component for transmission, will now be described, in which elements corresponding to those described above with reference to the prior art circuit of FIG. 1 are identified by the same reference numerals and a detailed description thereof will be omitted herein for the sake of brevity. As shown in the AM stereophonic transmitter of FIG. 3, a matrix circuit 3 produces the aforementioned sum signal (L+R) and difference (L−R) signal in response to the left (L) and right (R) channel stereophonic signals supplied to input terminals 1 and 2, respectively. The sum signal is phase shifted by −45° in phase shifting circuit 4 to produce a phase-shifted sum signal $X_-$, and the difference signal is phase shifted by +45° in phase shifting circuit 5 to produce a phase-shifted difference signal $Y_+$. The phase shifted difference signal $Y_+$ is then modulated by the phase shifted sum signal $X_-$ in a sub-modulator 12. In particular, in sub-modulator 12, the phase shifted difference signal $Y_+$ is modulated by a coefficient $1+m_tX_-$ to produce a first modulated output signal $Y_+(1+m_tX_-)$. The sub-modulation factor $m_t$ represents a coefficient indicating the degree of modulation performed by sub-modulator 12, and preferably has a value in the range from 0.5 to 1.0, as will be described in greater detail hereinafter. The first modulated output signal from sub-modulator 12 is supplied to one input of multiplier 7 to modulate a carrier signal $-\sin \omega_c t$ supplied to another input thereof, whereby multiplier 7 produces an orthogonal or second modulated output signal $-Y_+(1+m_tX_-) \sin \omega_c t$ which is supplied to one input of an adder 8.

The phase-shifted sum signal $X_-$ is supplied through a capacitor 13 to the non-inverting input of an operational amplifier 11. A DC offset circuit comprised of a resistor 14 and a DC power supply source 15 is connected in series between the non-inverting input of operational amplifier 11 and ground to provide a DC offset or carrier component "1" to the phase-shifted sum signal $X_-$. In this manner, an offset signal $1+X_-$ is supplied to the non-inverting input of operational amplifier 11. As will be discussed in greater detail hereinafter, a feedback signal $\sqrt{V_x^2+Y_+^2(1+m_tX_-)^2}$, is supplied to the inverting input of operational amplifier 11 so that the transmitted AM stereophonic signal F(t) has a substantially distortion-free envelope component E equal to $1+X_-$. In particular, as a result of the two signals supplied to the inputs of operational amplifier 11, assuming that the gain thereof is sufficiently large, the latter circuit produces a modified signal $V_x=\sqrt{(1+X_-)^2-Y_+^2(1+m_tX_-)^2}$ which is supplied to one input of multiplier 6. In this manner, the latter signal modulates a second carrier signal $\cos \omega_c t$ supplied to another input of multiplier 6, whereby multiplier 6 produces a third modulated output signal $\sqrt{(1+X_-)^2-Y_+^2(1+m_tX_-)^2} \cos \omega_c t$ which is supplied to another adding input of adder 8. Adder 8 thereafter adds the second modulated output signal from multiplier 7 with the third modulated output signal from multiplier 6 to produce an AM stereophonic signal F(t) which is supplied to an output terminal 16 for transmission and which is represented as follows:

$$F(t) = \sqrt{(1 - X_-)^2 - Y_+^2(1 + m_tX_-)^2} \cos \omega_c t - Y_-(1 + m_tX_-)\sin\omega_c t \quad (1)$$

It is to be appreciated that the envelope or amplitude of the AM stereophonic signal F(t) can be represented as follows:

$$E=1+X_-=1+(L+R)_{-45°} \quad (2).$$

In accordance with this invention, the AM stereophonic signal F(t) is supplied to an envelope detector 17 which produces the aforementioned feedback signal $\sqrt{V_X^2+Y_+^2(1+m_tX_-)^2}$ which is supplied to the inverting input of operational amplifier 11 to correct any distortion that may result in the envelope of the AM stereophonic signal.

It is to be appreciated that, with the transmitter of FIG. 3, the envelope component E of the transmitted AM stereophonic signal F(t) is substantially distortion-free. In addition, the transmitted AM stereophonic signal F(t) is perfectly compatible with conventional monaural receivers. It is to be appreciated that the above substantially distortion-free and compatible characteristics are achieved when the second carrier signal $\cos \omega_c t$ is modulated by the signal $\sqrt{(1+X_-)^2-Y_+^2(1+m_tX_-)^2}$ at the output of operational amplifier 11. In other words, because of the feedback signal supplied to the inverting input of operational amplifier 11, the signal $\sqrt{(1+X_-)^2-Y_+^2(1+m_tX_-)^2}$ is produced to correct distortion in the envelope of the AM stereophonic signal F(t) which is to be transmitted.

Figure 4:
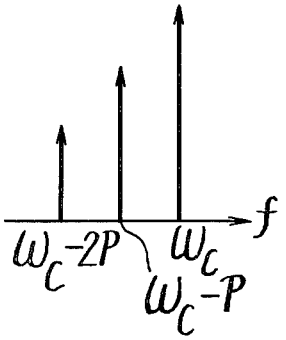
FIG. 4 is a graphical diagram used to explain the operation of the AM stereophonic transmitter of FIG. 3.

It is to be noted that, in the prior art, only a first order side band wave $\omega_c - P$ is provided for the left (L) channel, as shown in FIG. 2, whereby the envelope component of the AM stereophonic signal may contain a second order distortion component, as described above. In accordance with the present invention, a second order side band wave $\omega_c - 2P$ is added to the frequency spectrum, as shown in FIG. 4, to obtain the aforementioned substantially distortion-free envelope component. This results from the component $Y_+^2(1+m_tX_-)^2$ under the radical at the output of operational amplifier 11 and from the second term $Y_+(m_tX_-)$ from sub-modulator 12. In this regard, three spectrums are provided, comprised of the carrier $\omega_c$, the first order side band wave $\omega_c - P$ and the second order side band wave $\omega_c = 2P$ for the left (L) channel. It is to be appreciated that three frequency spectrums for the right (R) channel are also provided.

Figure 5:
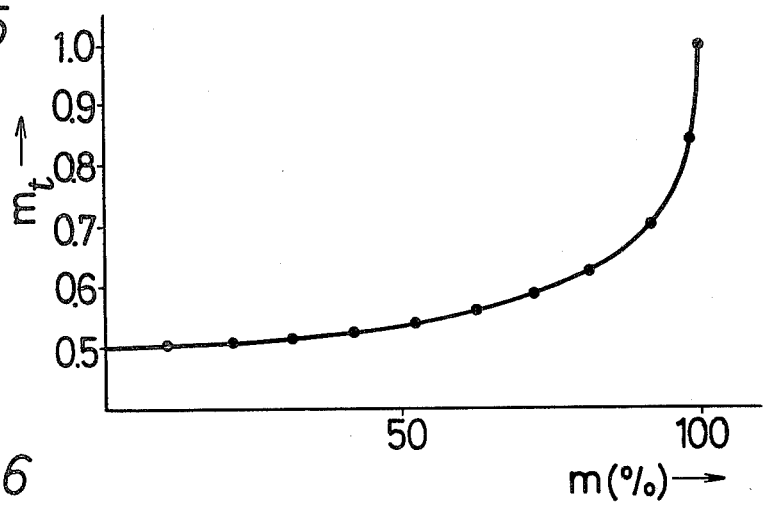
FIG. 5 is a graphical diagram illustrating the relation between the sub-modulation factor and the degree of modulation of a carrier signal.

In the above apparatus according to this invention, even if the sub-modulation factor $m_t = 0$, that is, if the sub-modulator 12 is omitted from the circuit of FIG. 3, compatibility with a monaural receiver can still be obtained, while still providing the aforementioned second order side band wave $\omega_c - 2P$. However, in order to reduce undesirable higher-order frequency spectrum components, the sub-modulation factor $m_t$ is selected in the range from 0.5 to 1.0. This is achieved when the relation between the sub-modulation factor $m_t$ and the amplitude modulation factor m of the sinusoidal carrier signal, that is, $\cos \omega_c t$, modulated in multiplier 6, becomes that shown in FIG. 5. Preferably, the sub-modulation factor $m_t$ is selected to be approximately 0.55, whereby a signal fairly approximated by only the three spectrums can be provided over a wide modulation range, that is, over a wide range of m, with any error in the most preferred value of $m_t$ being small. In accordance with the present invention, the levels of the third and higher order side band waves are less than −50 dB relative to the level of the carrier $\omega_c$, and are therefore negligible.

Figure 6:
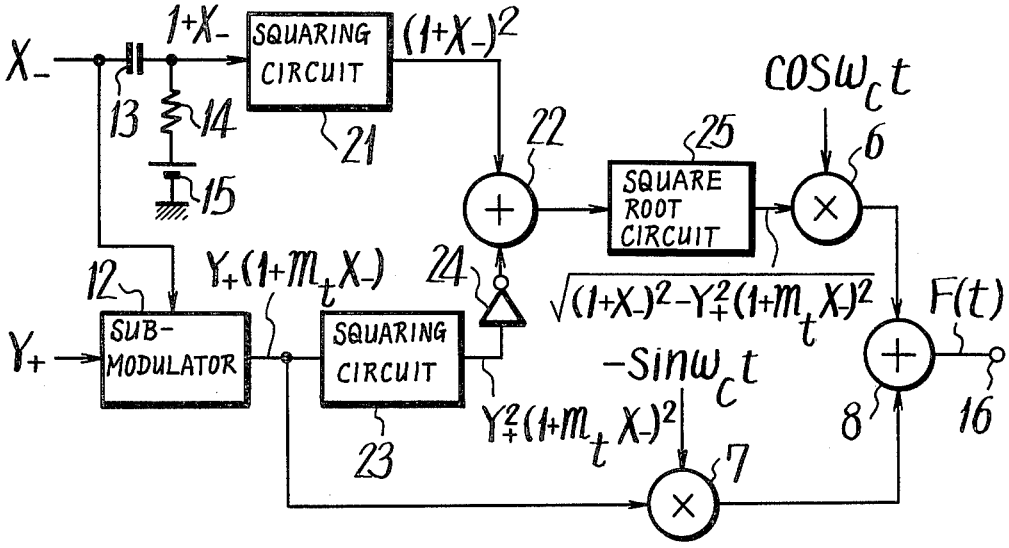
FIG. 6 is a block, circuit-wiring diagram of an AM stereophonic transmitter according to another embodiment of this invention.

Referring now to FIG. 6, an AM stereophonic transmitter according to another embodiment of this invention will now be described, in which elements corresponding to those previously described in relation to the transmitter of FIG. 3 are identified by the same reference numerals and a detailed description thereof will be omitted for the sake of brevity. In the AM stereophonic transmitter of FIG. 6, the offset, phase-shifted sum signal $1+X_-$ is supplied to a squaring circuit 21 which produces a squared offset signal $(1+X_{31})^2$ and supplies the same to an input of an adder 22. The first modulated output signal $Y_+(1+m_tX_-)$ from sub-modulator 12 is supplied to another squaring circuit 23 which produces a squared signal $Y_+^2(1+m_tX_-)^2$. This latter signal is inverted by an invertor 24 and then supplied to another input of adder 22 where it is added with the aforementioned squared signal $(1+X_-)^2$ to produce an output signal $(1+X_-)^2 - Y_+^2(1+m_tX_-)^2$. This latter signal is supplied to a square root circuit 25 which produces an output signal $\sqrt{(1+X_-)^2 - Y_+^2(1+m_tX_-)^2}$ which is supplied to one input of multiplier 6 to modulate the second carrier signal $\cos \omega_c t$ supplied to another input of multiplier 6. In this regard, multiplier 6 produces the aforementioned third modulated output signal $\sqrt{(1+X_-)^2 - Y_+^2(1+m_tX_-)^2} \cos \omega_c t$ and supplies the same to one input of adder 8. The output signal from sub-modulator 12 is also supplied to one input of multiplier 7 for modulating the first carrier signal $-\sin \omega_c t$ supplied to another input of multiplier 7, the latter circuit producing the aforementioned orthogonal or second modulated output signal $-Y_+(1+m_tX_-) \sin \omega_c t$ which is supplied to another input of adder 8. The latter adder combines the second and third modulated output signals from multipliers 7 and 6, respectively, to produce the AM stereophonic signal F(t) which is supplied to output terminal 16. It is to be appreciated that the AM stereophonic signal at output terminal 16 of FIG. 6 is identical to that produced at the output of the circuit of FIG. 3, and accordingly, the same advantages accrue therefrom.

Figure 7:
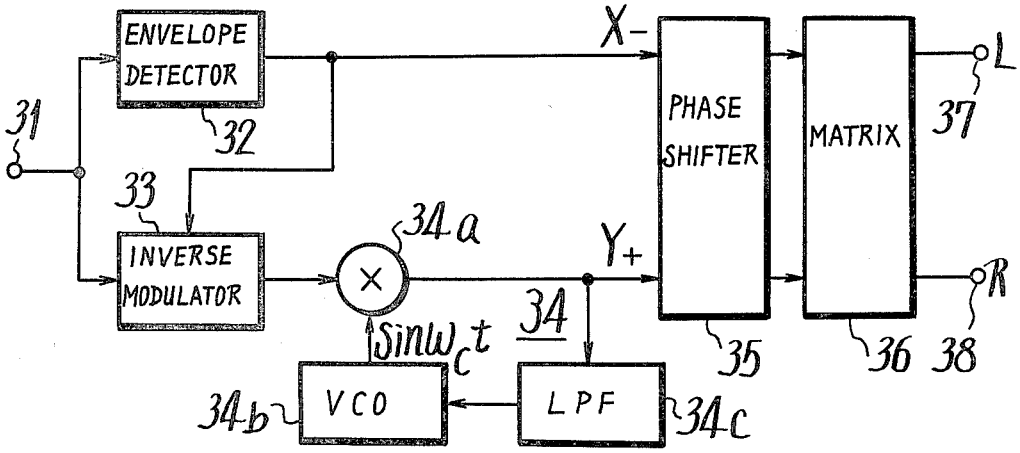
FIG. 7 is a block diagram of a portion of an AM stereophonic receiver complementary to the AM stereophonic transmitters of FIGS. 3 and 6.

Referring now to FIG. 7, a decoding portion of an AM stereophonic receiver complementary to the transmitters of FIGS. 3 and 6 according to this invention includes an envelope detector 32 supplied with an intermediate frequency signal from an input terminal 31. In particular, an intermediate frequency component of the transmitted AM stereophonic signal F(t) is envelope detected by envelope detector 32 to produce the phase-shifted sum signal $X_-$ which is supplied to one input of a phase shifting circuit 35. The intermediate frequency signal is also supplied from input terminal 31 to an inverse modulator 33 which is also supplied with the phase-shifted sum signal $X_-$. Inverse modulator 33 has a non-linear modulation function $1/(1+m_tX_-)$ to perform an inverse modulation operation. The output signal from inverse modulator 33 is then supplied to a synchronous detector 34. In particular, synchronous detector 34 includes a multiplier **34*a* supplied with the output signal from inverse modulator 33. The output signal from multiplier 34*a* is the aforementioned phase-shifted difference signal $Y_+$ which is supplied to phase shifting circuit 35 and also through a low-pass filter 34*c* to a voltage controlled oscillator (VCO) 34*b*, also of synchronous detector 34. VCO 34*b* supplies the first carrier signal $-\sin \omega_c t$ to multiplier 34*a* to produce the phase-shifted difference signal $Y_+$. The phase shifted sum signal $X_-$ from envelope detector 32 and the phase shifted difference signal $Y_+$ from synchronous detector 34 are supplied through phase shifting circuit 35 to a matrix circuit 36 which produces the left (L) and right (R) channel stereophonic signals in response thereto at output terminals 37 and 38, respectively. It is to be appreciated that, with the circuit of FIG. 7**, substantially distortion-free stereophonic demodulated signals having infinite separation can theoretically be obtained.

Accordingly, with the AM stereophonic transmitter according to the present invention, since the transmitted AM stereophonic signal F(t) is expressed by equation (1), there is perfect compatibility with a monaural receiver. In addition, third and higher order side band waves are effectively suppressed and a substantially distortion-free envelope component E of the AM stereophonic signal F(t) is produced. In addition, by means of the AM stereophonic transmitter of the ISB type according to the present invention, substantially distortion-free stereophonic demodulated signals and infinite separation can theoretically be obtained at a complementary AM stereophonic receiver.

It is to be appreciated that the AM stereophonic transmitter according to the present invention can be used with a conventional transmitter by dividing the AM stereophonic signal F(t) into a phase modulation (PM) component and an amplitude modulation (AM) component by means of a limiter, whereby a conventional transmitter can be utilized without being modified, in conjunction with the AM stereophonic transmitter according to this invention, by providing a suitable interface therebetween. Further, many modifications within the scope of this invention can be made by one of ordinary skill in the art. For example, a low pass filter may be provided between envelope detector 17 and the inverting input of operational amplifier 11.

Having described specific preferred embodiments of the invention with reference to the accompanying drawings, it is to be understood that the present invention is not limited to those precise embodiments and that various changes and modifications can be effected therein by one skilled in the art without departing from the scope or spirit of the invention as defined in the appended claims herein.

What is claimed is:

1. Apparatus for transmitting an AM stereophonic signal, comprising:

matrix means for generating a sum signal corresponding to the sum of left and right channel stereophonic signals and a difference signal corresponding to the difference between the left and right channel stereophonic signals;

phase shifting means for phase shifting said sum and difference signals to produce phase-shifted sum and difference signals having a phase difference of substantially 90° therebetween;

first modulating means for modulating the phase-shifted difference signal by the phase-shifted sum signal to produce a first modulated output signal;

second modulating means for modulating a first carrier by said first modulated output signal to produce a second modulated output signal;

means for modifying said phase-shifted sum signal to produce a modified signal;

third modulating means for modulating a second carrier by said modified signal to produce a third modulated output signal, the second carrier having a frequency equal to that of said first carrier and a phase shifted by substantially 90° from the phase of said first carrier; and adder means for adding said second and third modulated output signals to produce said AM stereophonic signal, said means for modifying being operative to provide said modified signal with characteristics by which said AM stereophonic signal has imparted thereto a substantially distortion-free envelope component, said AM stereophonic signal having the form $$\frac{\sqrt{(1+X_-)^2 - Y_+^2(1+m_tX_-)^2\cos\omega_c t}}{-Y_+(1+m_tX_-)\sin\omega_c t}$$

where $X_-$ represents said phase-shifted sum signal, $Y_+$ represents said phase-shifted difference signal, $m_t$ represents a sub-modulation factor of said first modulating means, 1 represents a carrier component, $\cos\omega_c t$ represents said second carrier signal, and $-\sin\omega_c t$ represents said first carrier signal.

2. Apparatus according to claim 1; in which said first modulating means has a sub-modulation factor and modulates said phase-shifted difference signal by a signal corresponding to the sum of a carrier component and the multiplied result of said sub-modulation factor with said phase-shifted sum signal.

3. Apparatus according to claim 2; in which said sub-modulation factor has a value in the range from 0.5 to 1.0.

4. Apparatus according to claim 1; in which said means for modifying includes envelope detecting means for envelope detecting said AM stereophonic signal from said adder means to produce an envelope-detected signal and operational amplifier means having a first input supplied with said phase-shifted sum signal and a second input supplied with said envelope-detected signal to produce said modified signal.

5. Apparatus according to claim 4; in which said means for modifying includes means for adding a carrier component to said phase-shifted sum signal to produce a combined signal and supplying said combined signal to said first input of said operational amplifier means.

6. Apparatus according to claim 1; in which said first carrier signal is a sine signal and said second signal is a cosine signal.

7. Apparatus for transmitting an AM stereophonic signal, comprising:

matrix means for generating a sum signal corresponding to the sum of left and right channel stereophonic signals and a difference signal corresponding to the difference between the left and right channel stereophonic signals;

phase shifting means for phase shifting said sum and difference signals to produce phase-shifted sum and difference signals having a phase difference of substantially 90° therebetween;

first modulating means for modulating the phase-shifted difference signal by the phase-shifted sum signal to produce a first modulated output signal;

second modulating means for modulating a first carrier by said first modulated output signal to produce a second modulated output signal;

means for modifying said phase-shifted sum signal including squaring means for producing a squared sum signal corresponding to the square of said phase-shifted sum signal and a squared modulated signal corresponding to the square of said first modulated output signal, inverting means for inverting said squared modulated signal to produce an inverted squared modulated signal, second adder means for adding said squared sum signal and said inverted squared modulated signal to produce a combined signal, and square root means for producing a modified signal corresponding to the square root of said combined signal;

third modulating means for modulating a second carrier by said modified signal to produce a third modulated output signal, the second carrier having a frequency equal to that of said first carrier and a phase shifted by substantially 90° from the phase of said first carrier; and adder means for adding said second and third modulated output signals to produce said AM stereophonic signal, said means for modifying being operative to provide said modified signal with characteristics by which said AM stereophonic signal has imparted thereto a substantially distortion-free envelope component.

8. Apparatus according to claim 7; in which said means for modifying includes means for adding a carrier component to said phase-shifted sum signal to produce a second combined signal and said squaring means produces said squared sum signal corresponding to the square of said second combined signal.

* * * * *